United States Patent [19]

Hendricks et al.

[11] 4,179,120

[45] Dec. 18, 1979

[54] BOWLING BALL KICKER PRESSURE DEVICE

[76] Inventors: Fred Hendricks, 3008 S. 134th St., Omaha, Nebr. 68144; Cassius W. Draper, 810 5th St., Fairbury, Nebr. 68352

[21] Appl. No.: 814,530

[22] Filed: Jul. 11, 1977

[51] Int. Cl.[2] ..... A63D 5/02

[52] U.S. Cl. ..... 273/49

[58] Field of Search ..... 273/43 R, 43 A, 43 E, 273/49

[56] References Cited

U.S. PATENT DOCUMENTS

| | | | |
|---|---|---|---|
| 2,767,983 | 10/1956 | Holloway et al. | 273/43 R |
| 3,297,322 | 1/1967 | Ernst et al. | 273/49 |

FOREIGN PATENT DOCUMENTS

| | | | |
|---|---|---|---|
| 1283685 | 8/1972 | United Kingdom | 273/49 |

*Primary Examiner*—Anton O. Oechsle

*Attorney, Agent, or Firm*—Henderson & Sturm

[57] ABSTRACT

A ball-kicker pressure device is provided for use in improving the operation of ball-kicker assemblies of the type which assist the introduction of bowling balls into a ball-lift device within an automatic pinspotter machine, having an automatic ball return mechanism. The device includes an adjustable pressure means rotatably affixed to the ball kicker assembly and adjustably affixed to the kickback plate of an automatic pinspotter machine.

9 Claims, 4 Drawing Figures

BOWLING BALL KICKER PRESSURE DEVICE

BACKGROUND OF THE INVENTION

Automatic bowling pinspotter machines have been designed to meet the rules and regulations of the game of ten pins as established by the American Bowling Congress. Such machines have received official A.B.C. approval and are in use in numerous bowling establishments. Of the approved machines, certain models perform several types of functions according to the requirements of the game, including returning the bowling ball. Modern technology, in addition, has produced some machines that are equipped with a ball return which operates continuously and independent of the cycles of the machine.

In a machine of the above description, the ball return mechanism includes a side to side sweeping rudder, a transverse ball trough, a ball-lift of the endless belt variety, and gravity return rails. The ball-lift carries the ball from the end trough high enough to permit a gravity return.

The endless-belt ball-lift is mounted between the side metal kickbacks of two adjacent machines and has an opening in the kickback plate permitting the ball to enter the lift after it has been bowled. A metal rudder sweeps back and forth between the kickback plates of each pair of machines, alternately blocking the ball opening on one machine while it allows the ball from the adjacent machine to enter the lift.

The lift proper consists of a moving belt and a track between which the ball enters. The moving belt forces the ball against the track and it is rolled up to the return rails. Tension on the belt is maintained by applying an outward force to the upper and lower yokes which support pulleys on either end of the belt.

In order to provide sufficient pressure against the belt to cause the ball to be lifted to the gravity rails, machines of this type employ a ball kicker assembly. The ball kicker assembly is a pivotally mounted shaft having pressure means and a driven rotatable cushioned roller. The roller exerts pressure upon the entering bowling ball causing it to contact the belt of the ball lift with sufficient pressure to engage the ball lift. The pressure means on the ball kicker assembly generally includes a series of pulleys and a driving belt running through the pulleys with a set of springs attached to the arm of an idler pulley thereby placing tension upon the pulley belt and ultimately tensioning the ball kicker assembly.

Through extensive operation, it has been found that the method of providing pressure for the ball kicker by the use of the pulley arrangement has been inadequate and the ball kicker skips or hops on the ball thereby failing to provide adequate friction to cause the ball to engage the ball-lift device.

Various methods of correcting the skipping problem have been attempted without lasting success. One such method of correcting the ball kicker problem was to constantly change the cushioned roller on the ball kicker assembly. Another method utilized was to increase the spring tension on the idler pulleys. Neither of these attempts met with lasting success as the roller on the free end of the ball kicker assembly continued to skip and miss contact with the bowling ball unless the roller was constantly replaced. The resultant continual replacement of parts is both expensive and time consuming.

Increasing the number of springs on the idler pulleys contributed to additional wear on the belt but did little to correct the problem of the ball kicker skipping on the bowling ball. When the ball kicker skips the bowling ball becomes stuck in the machine and frustrates the bowler.

There is, consequently, a need for a ball kicker pressure device, which can be conveniently attached to existing automatic bowling pinspotter machines to improve the handling and introduction of the bowling ball to the ball lift device.

Of the known prior art devices, none meet the existing need for a device which is simple, compact, inexpensive to maintain, contains few moving parts, is easily adapted to existing machines, is dependable with a decreased danger of breakdown, is inexpensive to manufacture, can be easily adjusted to provide the proper tension, and is capable of providing the proper pressure on the bowling ball to assist the ball into the ball lift device within the automatic bowling pinspotter machine.

The instant invention is directed to a novel device and method which meets all of these existing needs.

BRIEF SUMMARY OF THE INVENTION

The present invention relates to a device for providing pressure on a bowling ball so that it can be lifted by a ball lifting device to the gravity rails of the ball return. This device is easily adapted to existing automatic pinspotter machines of the type which employ a ball kicker and endless-belt ball-lift apparatus.

In the present invention, a rod is adjustably connected to an upper end of the roller bracket assembly (ball kicker). The other end of the rod is adjustably affixed through a spring biasing method to the kickback plate of the bowling machine. The rod is rotatably mounted within the roller bracket assembly and is also rotatably affixed to the kick back plate. The attachment of the present invention to the ball kicker assembly provides direct pressure means connected to the roller bracket assembly which places pressure upon the bowling ball by way of the cushioned roller affixed to the free end of the roller bracket assembly.

A primary object of the present invention then, is to provide a device for adjustably pressuring the ball kicker assembly to provide sufficient pressure upon a bowling ball to assist the introduction of the ball into the ball lift device.

Another object of the instant invention is to eliminate the costs and expense of replacing the cushioned roller on the ball kicker assembly by providing an alternate pressure means.

A further object of the invention is to provide a simple, easy to manufacture device for improving the ball kicker assembly operation in an automatic pinspotting machine.

A still further object of the invention is to provide a ball kicker pressure device which is simple, compact, inexpensive to maintain, contains few moving parts, is durable in use, and is extremely reliable.

Other objects, advantages, and novel features of the present invention will become apparent from the following detailed description of the invention when considered in conjunction with the accompanying drawings.

BRIEF DESCRIPTION OF THE DRAWINGS

For better understanding of the invention as well as other objects and further features thereof, reference is made to the following detailed disclosure of the invention taken in conjunction with the accompanying drawings wherein.

DESCRIPTION OF THE PREFERRED EMBODIMENTS

Figure 1:
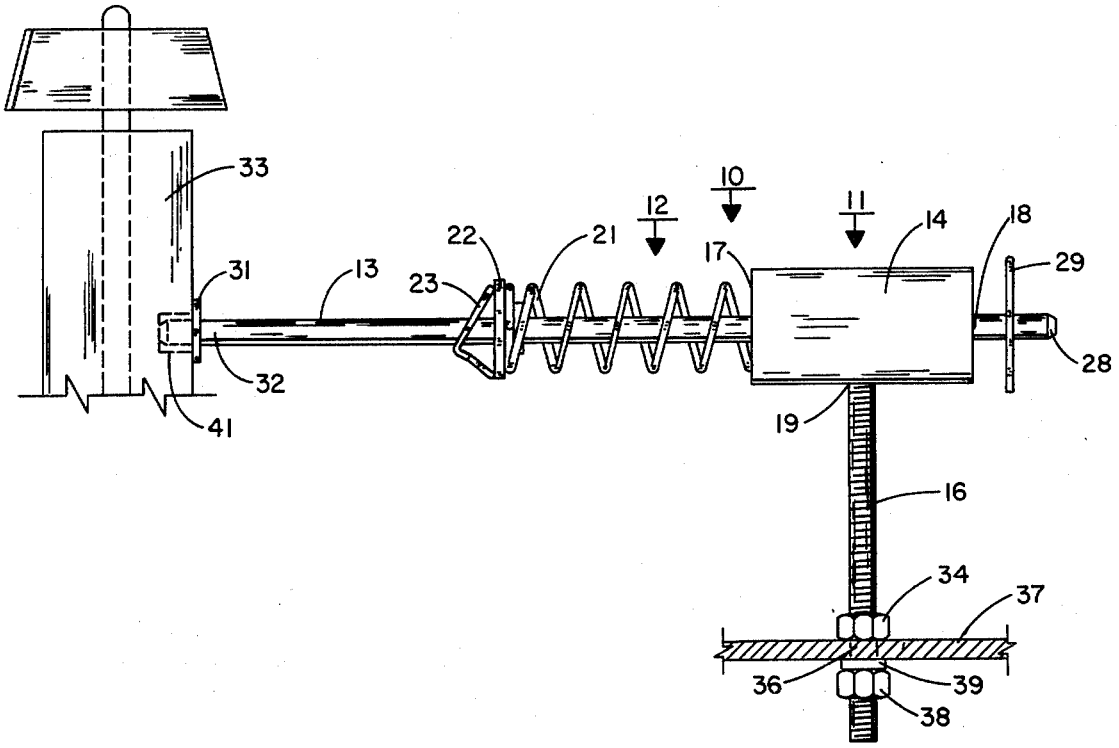
FIG. 1 is a perspective view of the bowling ball kicker pressure device in place in an automatic pinspotting and ball return machine.

Referring now to the drawings, and in particular to FIG. 1, the device may be seen generally depicted by the numeral 10. More particularly, the device 10 consists of a main housing unit 11, a spring means 12 and a rod 13.

Figure 2:
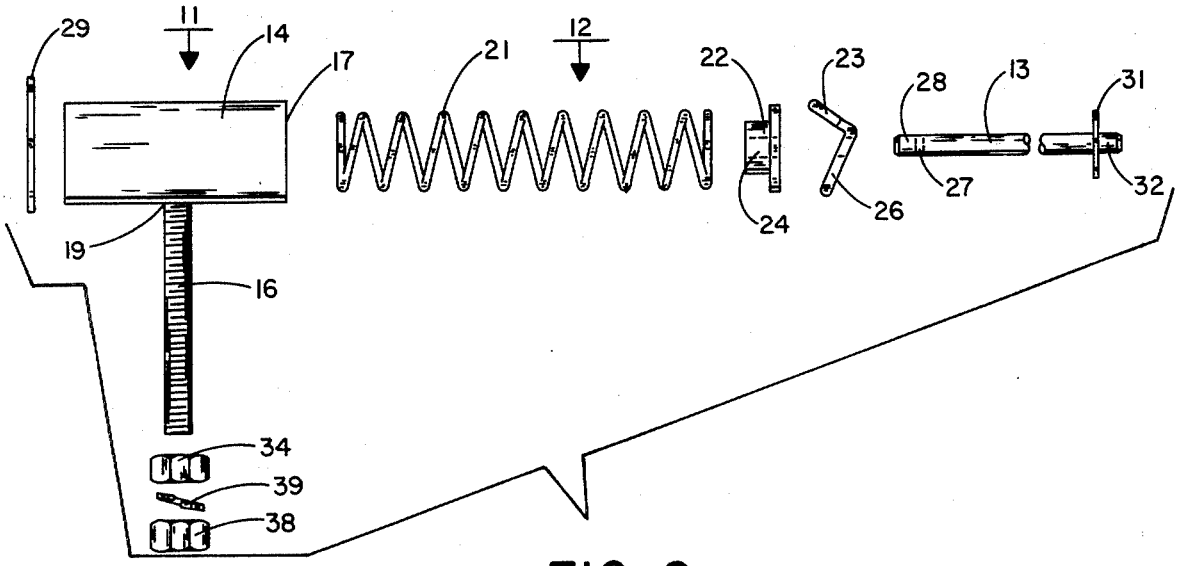
FIG. 2 is an exploded side view illustrating the component parts of the invention.
Figure 3:
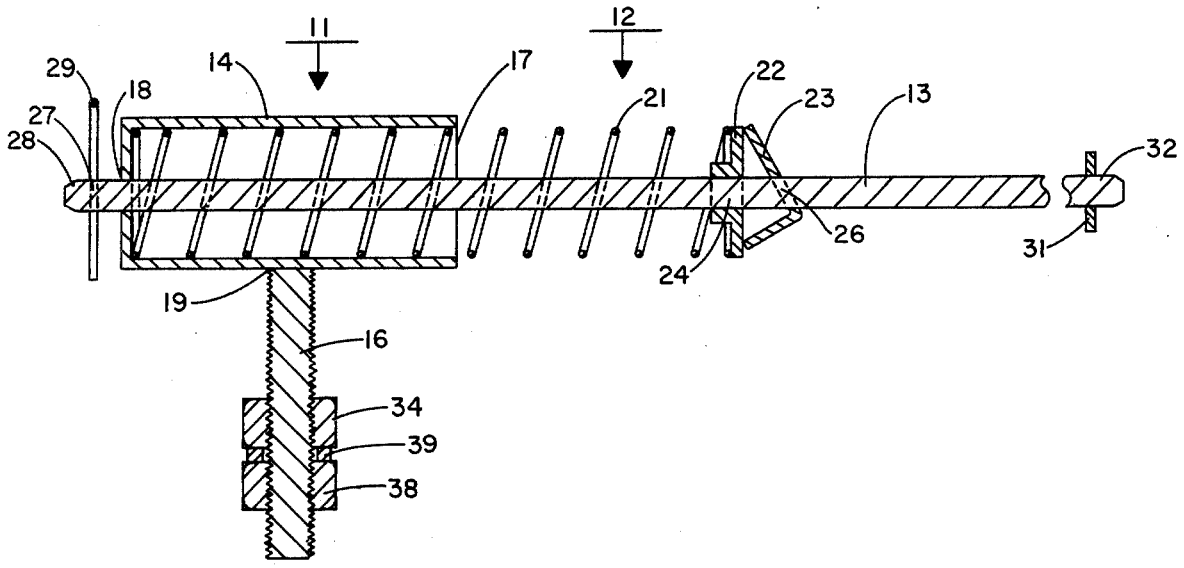
FIG. 3 is a partial side longitudinal view, in section, illustrating the assembled invention.
Figure 4:
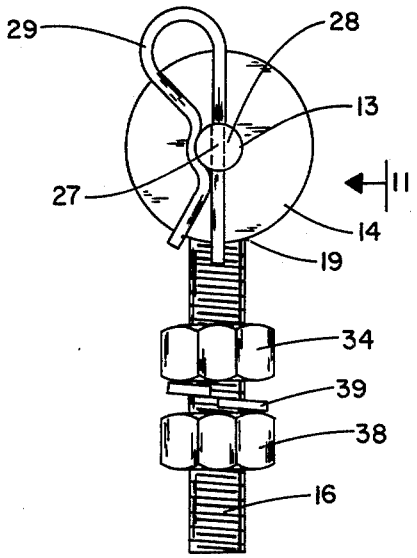
FIG. 4 is an end view of the invention.

The main housing unit 11 includes a cylindrically shaped sleeve 14 and a bolt arm 16. The sleeve 14 has a large diameter opening 17 at the one end (as seen in FIG. 3) and a small diameter opening 18 at the other end. Both openings 17 and 18 are circular and centrally located about a common longitudinal center line. The bolt arm 16 is affixed to the exterior side of the sleeve 14 as denoted in FIGS. 1, 2 and 3 by the numeral 19 and is disposed radially therefrom.

The spring means 12 includes a spring 21 that is inserted longitudinally into the sleeve 14 and is disposed co-linearly therefrom. A spring collar 22 is provided to work in conjunction with a spring retaining clip 23, the operation of which will be disclosed more fully below.

The rod 13 is a cylindrically shaped rigid shaft disposed along the axial centerline of the sleeve 14 and through the small diameter opening 18 in the back of the sleeve 14. The rod 13 is also disposed through the spring collar 22 and the spring retaining clip 23, through openings 24 and 26 provided therein. A radial hole 27 is provided through the rod 13 at the second end 28 of the rod 13 through which a pin 29 is inserted, thereby preventing the rod 13 from withdrawing through the small diameter opening 18. A stopper plate 31 is provided at the first end 32 of the rod 13 to facilitate proper connection with the ball kicker assembly 33.

Installation of the assembled device 10 may now be disclosed as follows. A nut 34 is threaded up the bolt arm 16. The bolt arm 16 is inserted through a drilled hole 36 in the kick back plate 37 and secured thereto by a second nut 38 and a lock washer 39. The stopper plate 31 of the rod 13 is inserted into a hole 41 drilled into the ball kicker assembly 33. The spring 21 is then inserted as far as it will go into the sleeve 14. The spring collar 22 is placed flush with the second end of the spring 21, and the spring retaining clip 23 is pushed up against the collar 22 until the proper pressure against the ball kicker assembly 33 is obtained.

The retaining clip 23 is thereupon released thereby locking the spring 21 in place at the proper tension.

In another embodiment (not shown), the spring collar 22 is rigidly affixed to the rod 13 so that the spring 21 is held in a preadjusted position and spring retaining clip 23 is not employed.

In operation, the assembled device 10 described above will maintain pressure on the ball kicker assembly 33 thereby contributing to the proper operation of the ball return mechanism (not shown).

It will be readily observed by those skilled in the art that many other embodiments are possible that do not depart from the invention disclosed above or claimed hereafter.

We claim:

1. In an automatic bowling pin spotter apparatus having a ball return mechanism of the type which includes an endless belt ball lift, a ball kicker assembly having a powered ball kicker wheel rotatably mounted on a pivotal shaft and a side kick back plate disposed proximate the ball kicker assembly, an improved ball kicker pressure device therein and therewith comprising:

(a) a rod having a first end and a second end, said second end adapted to be operably disposed against the ball kicker pivotal shaft;

(b) mounting means for mounting the device to the kickback plate, said mounting means slidably connected to the second end of the rod; and (c) spring biasing means for exerting force between said rod and the mounting means, said spring biasing means operably connected between said mounting means and said rod.

2. The ball kicker pressure device as described in claim 1 wherein the spring biasing means is comprised of a spring sleeve having a first end and a second end, said second end adapted to be fixed to and partially enclosing a spring, and said first end open to encompass a spring, said spring having a first end and a second end, said second end disposed within the sleeve, and wherein said mounting means is comprised of a threaded member attached to and projecting substantially perpendicular to said sleeve, said member adapted to be connected to the kick back plate.

3. The ball kicker pressure device as described in claim 2 further comprising an axial restraint means removably affixed to the second end of said rod.

4. The ball kicker pressure device as described in claim 3 wherein the second end of the rod includes a hole and the axial restraint means is comprised of a cotter pin removably inserted in said hole in the second end of said rod.

5. The ball kicker pressure device as described in claim 4 further comprising: a spring retaining collar slidably connected to the rod and affixed to the first end of the spring.

6. The ball kicker pressure device as described in claim 5 further comprising a clip slidably connected to the rod and located between the spring retaining collar and the stopper plate along the rod, whereby the spring tension is adjusted with the movement of said clip.

7. The ball kicker pressure device as described in claim 6 wherein said first end of the rod includes a stopper plate rigidly affixed proximate to said first end.

8. The ball kicker pressure device as described in claim 7 further comprising a means for locking the mounting means securely to the kickback plate.

9. A ball kicker pressure device as described in claim 6 further comprising an adjustable spring stopping means affixed to the spring biasing means and adjustable along the rod.

* * * * *